US009283745B2

(12) United States Patent
Park et al.

(10) Patent No.: US 9,283,745 B2
(45) Date of Patent: Mar. 15, 2016

(54) PRINTING DEVICE

(71) Applicant: Samsung Display Co., Ltd., Yongin (KR)

(72) Inventors: Jun-Ha Park, Yongin (KR); Dong-Hoon Lee, Yongin (KR); Haraguchi Kazuhiro, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/060,071

(22) Filed: Oct. 22, 2013

(65) Prior Publication Data

US 2014/0368578 A1 Dec. 18, 2014

(30) Foreign Application Priority Data

Jun. 13, 2013 (KR) ..... 10-2013-0067928

(51) Int. Cl.
*B41J 2/21* (2006.01)
*B41J 2/005* (2006.01)
*B41J 3/407* (2006.01)

(52) U.S. Cl.
CPC . *B41J 2/005* (2013.01); *B41J 3/407* (2013.01)

(58) Field of Classification Search
CPC ..... B41J 2/1631; B41J 2/1628; B41J 2/1642; B41J 2/1623; B41J 2/1639; B41J 25/308; F21K 9/90; F21Y 2105/008; H01L 25/048; H01L 27/32; H01L 2227/32
USPC ..... 347/44, 20
See application file for complete search history.

(56) References Cited

U.S. PATENT DOCUMENTS

| | | | | |
|---|---|---|---|---|
| 6,299,286 | B1 * | 10/2001 | Matsumoto | B05C 5/007 347/21 |
| 6,467,893 | B1 * | 10/2002 | Matsumoto et al. | 347/98 |
| 6,767,473 | B2 * | 7/2004 | Fujita et al. | 216/27 |
| 2001/0015735 | A1 * | 8/2001 | Matsumoto | 347/20 |
| 2002/0057302 | A1 * | 5/2002 | Shimomura et al. | 347/8 |
| 2002/0105688 | A1 * | 8/2002 | Katagami et al. | 358/505 |
| 2002/0149313 | A1 * | 10/2002 | Yonekura et al. | 313/500 |
| 2004/0114095 | A1 * | 6/2004 | Lee et al. | 349/187 |
| 2004/0251783 | A1 * | 12/2004 | Kanaya et al. | 310/328 |

(Continued)

FOREIGN PATENT DOCUMENTS

| | | |
|---|---|---|
| JP | 1993-011105 | 1/1993 |
| JP | 2003-001171 | 1/2003 |

(Continued)

*Primary Examiner* — Matthew Luu
*Assistant Examiner* — Patrick King
(74) *Attorney, Agent, or Firm* — H.C. Park & Associates, PLC

(57) ABSTRACT

Disclosed is a printing device includes a substrate fixing unit to a bottom of which a substrate is fixed. The device includes a solution discharge unit separately disposed in a bottom direction and spaced apart from the substrate fixing unit and to deliver a printing solution to the substrate by discharging printing solutions with various colors. The device includes a solution supply unit to supply the printing solution to the solution discharge unit. The device also includes a drive unit configured to control the substrate fixing unit to move with respect to the solution discharge unit or to control the solution discharge unit to move with respect to the substrate fixing unit.

17 Claims, 11 Drawing Sheets

(56) References Cited

U.S. PATENT DOCUMENTS

| | | | | |
|---|---|---|---|---|
| 2006/0073270 | A1* | 4/2006 | Kawase | 427/66 |
| 2006/0146379 | A1* | 7/2006 | Katagami et al. | 358/505 |
| 2008/0129785 | A1* | 6/2008 | Hano et al. | 347/54 |
| 2009/0128937 | A1* | 5/2009 | Sano | 359/885 |
| 2009/0303275 | A1* | 12/2009 | Ito et al. | 347/17 |
| 2010/0087945 | A1* | 4/2010 | Nakajima | G02F 1/1303 700/105 |
| 2011/0274848 | A1* | 11/2011 | Kawazoe | 427/424 |
| 2013/0106942 | A1* | 5/2013 | Kim et al. | 347/20 |

FOREIGN PATENT DOCUMENTS

| | | | | |
|---|---|---|---|---|
| JP | 2003001171 | A * | 1/2003 | B05C 5/02 |
| JP | 2010-195034 | | 9/2010 | |
| JP | 2011-245732 | | 12/2011 | |
| KR | 10-2010-0083619 | | 7/2010 | |

* cited by examiner

PRINTING DEVICE

CROSS-REFERENCE TO RELATED APPLICATION

This application claims priority to and the benefit of Korean Patent Application No. 10-2013-0067928 filed on Jun. 13, 2013, which is hereby incorporated by reference for all purposes as if fully set forth herein.

BACKGROUND OF THE INVENTION

1. Field of the Invention

Exemplary embodiments of the present invention relate to a printing device.

2. Description of the Background

When an organic light emitting diode (OLED) display is manufactured, a pattern configured with red, green, and blue is printed on a substrate. Various approaches for forming the pattern have been proposed. Among them, one of the methods has been proposed to an inkjet printing for controlling fine droplets and discharging the same. Another method provides to a nozzle printing for using a reciprocal motion of a continuously discharging nozzle and a relative pitch movement of a substrate.

A conventional printing device is provided to print a printing solution on a top surface of the substrate so that a driver is used to move the nozzle on a top side of the substrate. Accordingly, printing quality may be deteriorated by a fallen foreign particle caused by a driving process of the driver.

Also, in a case of an inkjet printing device, the printing solution is discharged as droplets so that additional time for smoothing a film is may be needed and the drying time may be long.

Since the above-noted printing methods can be performed while a head moves at a high speed at the top of the substrate, it is difficult to print particles at accurate positions. Also, typically the printing method is performed by the reciprocal motion of the head so that the printing tact is increased. Further, it is difficult for the inkjet printing device to form a precise pattern because of an external air flow or other influences due to the light weight of the droplet-shaped printing solution.

The above information disclosed in this Background section is only to set up Applicant's recognition of problems within existing art and merely for enhancement of understanding of the background of the invention based on the identified source of problems, and therefore the above information cannot be used as prior art in determining obviousness into the present invention.

SUMMARY OF THE INVENTION

Exemplary embodiments of the present invention provide a printing device for forming a precise pattern on a substrate.

Additional features of the invention will be set forth in the description which follows, and in part will be apparent from the description, or may be learned by practice of the invention.

Still other aspects, features, and advantages of the present invention are readily apparent from the following detailed description, simply by illustrating a number of particular embodiments and implementations, including the best mode contemplated for carrying out the present invention. The present invention is also capable of other and different embodiments, and its several details can be modified in various obvious respects, all without departing from the spirit and scope of the present invention. Accordingly, the drawing and description are to be regarded as illustrative in nature, and not as restrictive.

Exemplary embodiments of the present invention disclose a printing device. The printing device includes a substrate fixing unit configured to have a substrate fixed thereto. The printing device spaced apart from, and disposed below, the substrate fixing unit and configured to deliver a printing solution to the substrate by discharging printing solutions with various colors. The printing device includes a solution supply unit that is configured to supply the printing solution to the solution discharge unit. The printing device includes a drive unit that is configured to control the substrate fixing unit to move with respect to the solution discharge unit or to control the solution discharge unit to move with respect to the substrate fixing unit.

Exemplary embodiments of the present invention disclose a method. The method includes fixing a substrate to a bottom surface of a substrate fixing unit. The method includes disposing a solution discharge unit in a bottom direction and spaced apart from the substrate fixing unit and causing to deliver a printing solution to the substrate by discharging printing solutions with various colors. The method includes disposing a solution supply unit causing to supply the printing solution to the solution discharge unit. The method also includes disposing a drive unit causing to control the substrate fixing unit to move with respect to the solution discharge unit or causing to control the solution discharge unit to move with respect to the substrate fixing unit.

It is to be understood that both the foregoing general description and the following detailed description are exemplary and explanatory and are intended to provide further explanation of the invention as claimed.

DETAILED DESCRIPTION OF THE ILLUSTRATED EMBODIMENTS

Figure 1:
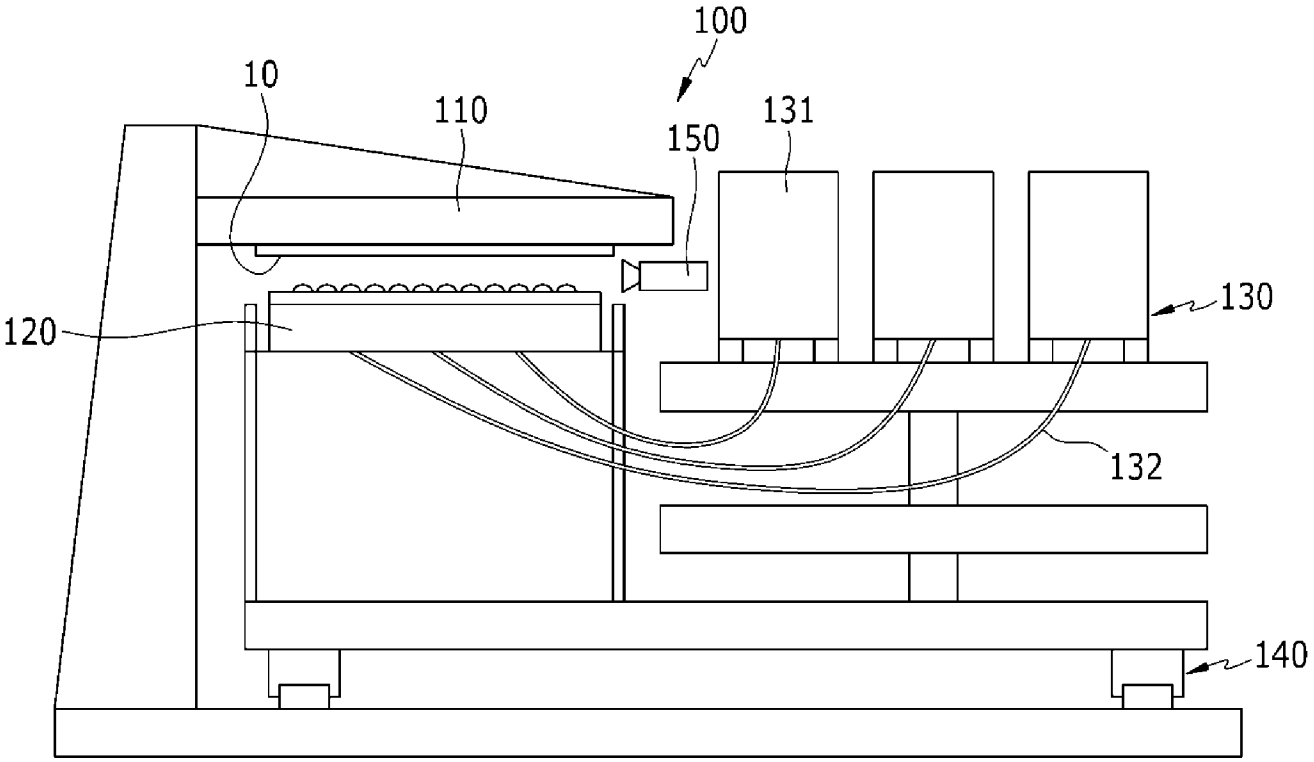
FIG. 1 shows a printing device according to exemplary embodiments of the present invention.

A printing device and a method for making a printing device are disclosed. In the following description, for the purposes of explanation, numerous specific details are set forth in order to provide a thorough understanding of the present invention. It is apparent, however, to one skilled in the art that the present invention may be practiced without these specific details or with an equivalent arrangement. In other instances, well-known structures and devices are shown in block diagram form in order to avoid.

Further, in exemplary embodiments, the same constituent elements are denoted by the same reference numerals and are described only in an exemplary embodiment, and in other exemplary embodiments, only constituent elements different from those of the exemplary embodiment will be described to avoid unnecessarily obscuring the present invention.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "indirectly coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 shows a printing device according to exemplary embodiments of the present invention.

Referring to FIG. 1, the printing device 100 according to exemplary embodiments may include a substrate fixing unit 110, a solution discharge unit 120, a solution supply unit 130, and a drive unit 140.

For example, a substrate 10 may be fixed to a bottom of the substrate fixing unit 110. The substrate fixing unit 110 can fix the substrate 10 by various methods, such as a vacuum absorption method or a static electricity method. The substrate fixing unit 110 is configured to arrange a position of the substrate 10. Also, the substrate fixing unit 110 can be configured to easily insert or discharge the substrate 10.

The substrate fixing unit 110 is configured to turn the substrate 10 upside down. For example, a configuration of a substrate fixing unit of a general printing device can be applicable to the above-noted substrate fixing unit 110.

The solution discharge unit 120 may be separately disposed downward from the substrate fixing unit 110. The solution discharge unit 120 discharges the printing solution upward to print the printing solution to the substrate 10. The printing solution discharged through the solution discharge unit 120 is continuously discharged to the substrate by viscosity. An inside of the solution discharge unit 120 has a manifold configuration so the printing solution supplied by the solution supply unit 130 is uniformly provided and is discharged at the bottom of the substrate 10.

The drive unit 140 controls the substrate fixing unit 110 to move with respect to the solution discharge unit 120. Also, the drive unit 140 controls the solution discharge unit 120 to move with respect to the substrate fixing unit 110. That is, the drive unit 140 controls the substrate fixing unit 110 and the solution discharge unit 120 to mutually move in a relative manner with respect to each other.

In FIG. 1, the drive unit 140 is shown to be formed as a part of the solution discharge unit 120 to move the solution discharge unit 120, but it is not limited by this configuration. For example, it is possible for the drive unit 140 to be formed at the bottom of the substrate fixing unit 110 to move the substrate fixing unit 110 while the solution discharge unit 120 is fixed.

For the purpose of explanation it will be assumed that the solution discharge unit 120 is moved by the drive unit 140.

The solution discharge unit 120 is maintained to be parallel with the substrate 10 by the drive unit 140, and moves so that the printing solution may be discharged to the substrate 10. The drive unit 140 can move the solution discharge unit 120 at a constant speed so that the printing solution may be uniformly coated on the substrate 10.

For example, although not shown, the drive unit 140 may include a motor, a screw rotated by the motor, a linear motion (LM) guide for a linear reciprocal motion caused by rotation of the screw, and a position sensor for sensing a position of the LM guide.

While the solution discharge unit 120 is combined to the LM guide, the screw is rotated by the motor and the LM guide moves. Accordingly, the solution discharge unit 120 moves and discharges the printing solution to the substrate 10. Here, the drive unit 140 should not be limited to the above-described configuration and as other configurations can be used to move the solution discharge unit 120 or the substrate fixing unit 110.

The drive unit 140 can be installed at a lower position than a height at which the printing solution is discharged to the substrate 10. Accordingly, neighboring air flows generated by a motion of the operation of the drive unit 140 thereby minimizing an influence on the printing solution discharged by the solution discharge unit 120.

For example, a shape of the solution discharge unit 120 can be extended in an orthogonal direction to a relative moving direction with respect to the substrate fixing unit 110. For example, when the substrate fixing unit 110 and the solution discharge unit 120 relatively move in a length direction of the substrate 10 while the substrate 10 has a rectangular shape, the solution discharge unit 120 can be formed to cross a relatively short width of the substrate 10

A length of the solution discharge unit 120 can be similar to the width of the substrate 10. A detailed configuration of the solution discharge unit 120 will be described later.

In addition, the solution discharge unit 120 may include a distance measurer 150.

The distance measurer 150 is disposed near an edge of the solution discharge unit 120 to measure a distance between the substrate 10 and the solution discharge unit 120. The distance between the substrate 10 and the solution discharge unit 120 is stably maintained by the distance measurer 150.

The solution supply unit 130 supplies the printing solution to the solution discharge unit. For example, the solution supply unit 130 may include a storage tank 131 and a supply duct 132. The storage tank 131 stores the printing solution. The supply duct 132 connects the storage tank 131 and the solution discharge unit 120. Further, a liquid-level measuring sensor for measuring a height of the stored printing solution can be disposed to the storage tank 131.

An exemplary method for the solution supply unit 130 to supply the printing solution to the solution discharge unit 120 can be applied by using a natural supply method caused by a capillary phenomenon or a forcible supply method using a pump.

For example, when the forcible supply method using a pump is applied to the solution supply unit 130, the solution supply unit 130 may include a pump. Further, the solution supply unit 130 may further include a mass flow controller (MFC) for precisely controlling a discharge amount of the printing solution, and a pressure control sensor.

In this example, when an excessive amount of the printing solution is supplied by the pump, a meniscus may not be formed and the printing solution may overflow, and when there is an insufficient supply of the printing solution, the meniscus may not be formed. Therefore, to prevent these problems, it is desirable to form an optimized meniscus shape by using the pressure control sensor and the mass flow controller in the storage tank 131, allowing the printing solution to contact the substrate 10 and form a bead.

Also, the solution supply unit 130 may include a deaerator (not shown). The deaerator removes bubbles in the storage tank 131 to prevent poor coating of the printing solution caused by the bubbles. The deaerator can use any devices that are used for removing bubbles in a liquid.

The solution supply unit 130 may further include a lifter (not shown). The lifter may be formed at a bottom of the storage tank 131 to raise or lower the storage tank 131. It is possible, as described above, to supply the printing solution to the solution discharge unit 120 by using a pump. In addition, the printing solution can be supplied to the solution discharge unit 120 by a change of a height of the storage tank 131 caused by the lifting process of the lifter.

Figure 2:
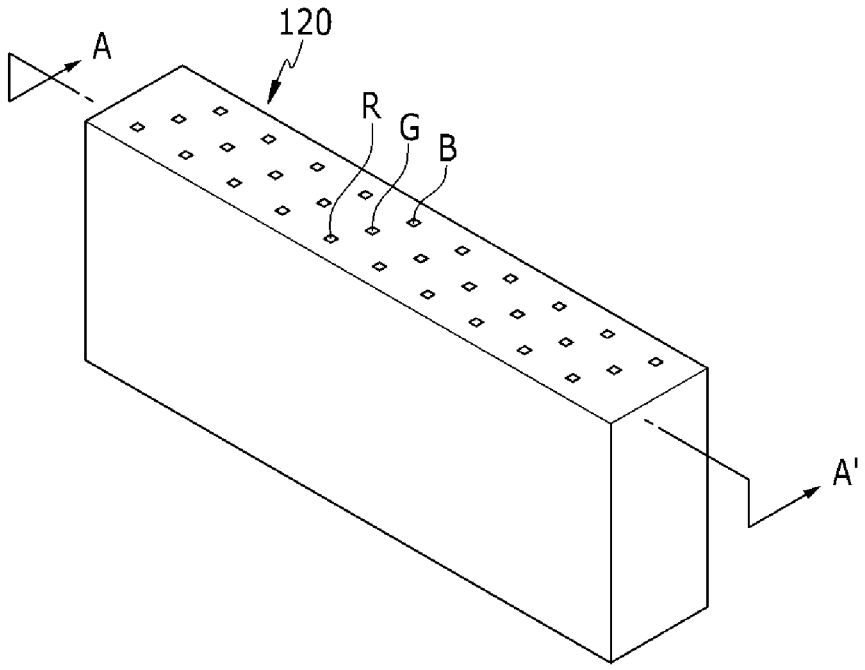
FIG. 2 shows a perspective view of a solution discharge unit in a printing device shown in FIG. 1.
Figure 3:
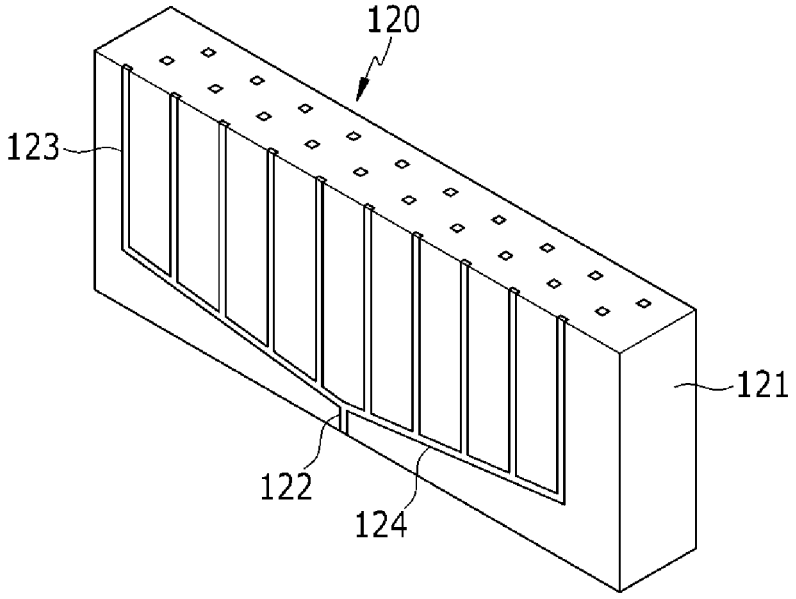
FIG. 3 shows a cross-sectional view with respect to a line A-A' in a solution discharge unit shown in FIG. 2.
Figure 4:
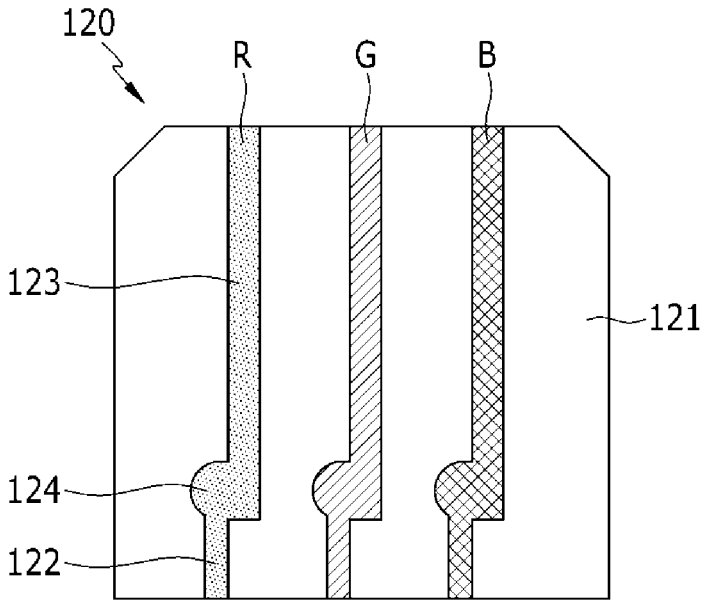
FIG. 4 shows a cross-sectional view of a solution discharge unit shown in FIG. 2.

FIG. 2 shows a perspective view of a solution discharge unit in a printing device according to exemplary embodiments shown in FIG. 1, FIG. 3 shows a cross-sectional view with respect to a line A-A' in a solution discharge unit shown in FIG. 2, and FIG. 4 shows a cross-sectional view of a solution discharge unit shown in FIG. 2.

Referring to FIG. 2 to FIG. 4, a detailed configuration of the solution discharge unit 120 may include, for example, a body member 121, an injection hole 122, a discharge hole 123, and a divergence hole 124.

The body member 121 becomes a body of the solution discharge unit 120. For example, the body member 121 may have a shape of a square column, and it is not limited thereto.

The injection hole 122 may be formed at a bottom or a side of the body member 121. There can be one or more injection holes 122. The injection hole 122 can be connected to the supply duct 132 connected to the storage tank 131 of the solution supply unit 130. The printing solution supplied by the solution supply unit 130 can be injected through the injection hole 122.

When the solution discharge unit 120 included in the printing device 100 according to the exemplary embodiments discharges the printing solution with three colors, three injection holes 122 can be formed in the body member 121.

In this example, the colors of the printing solution supplied to the three injection holes 122 can be red (R), green (G), and blue (B).

The discharge hole 123 passes through a top of the body member 121 to reach a part that is near the bottom of the body member 121. The printing solution is discharged to the substrate 10 through the discharge hole 123. The discharge hole 123 can be formed with various patterns on the top of the body member 121.

The discharge hole 123 can be formed to be a quadrangular, a circular, or an oval shape. That is, the shape of the discharge hole 123 depends on the design configuration.

The divergence hole 124 is diverged from one of the injection holes 122. The divergence hole 124 is connected to a plurality of discharge holes 123. The printing solution supplied through one injection hole 122 can be shifted to a plurality of discharge holes 123 through the divergence hole 124.

For example, the divergence hole 124 may have a semi-cylindrical shape. The divergence hole 124 with a semi-cylindrical shape functions as a buffer for temporarily storing the printing solution so that a predetermined amount of the printing solution supplied by the injection hole 122 may be temporarily stored and be stably supplied to the discharge hole 123. The divergence hole 124 can be a space for stabilizing a flow of the printing solution.

The divergence hole 124 can be formed to have an upward slope as it becomes distant from the injection hole 122. In this example, the printing solution may be uniformly shared and supplied up to the discharge hole 123 provided at a side of the body member 121 when the injection hole 122 is provided in a center of the body member 121.

For example, an inclined angle of the divergence hole 124 may be 0° to 5° with respect to a bottom surface of the body member 121. It is desirable for the discharge hole 123 to be formed with an interior diameter which generates the capillary phenomenon so that the printing solution supplied by the divergence hole 124 may fluently move upward.

The solution discharge unit 120 has a manifold configuration as its internal configuration. Because of the manifold configuration, a predetermined amount of the printing solution is stably discharged through the discharge hole 123.

Figure 5:
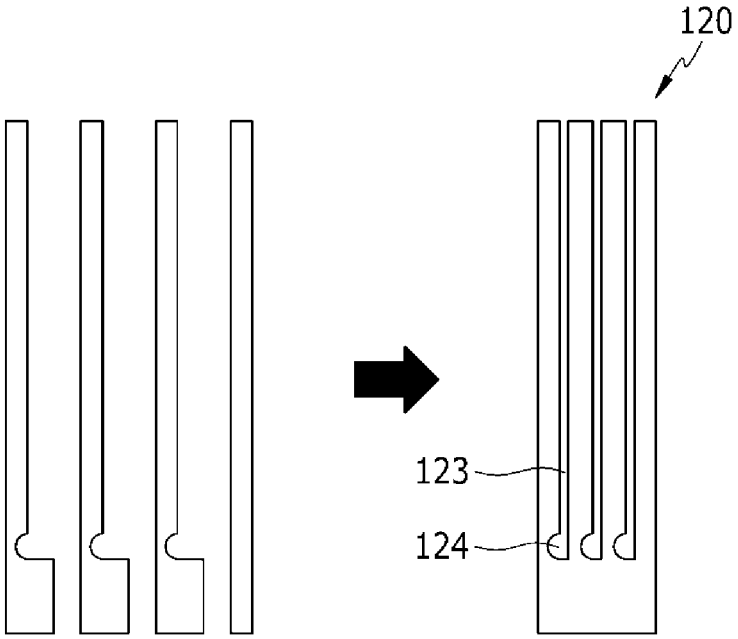
FIG. 5 shows an example of a method for manufacturing a solution discharge unit shown in FIG. 2.

FIG. 5 shows an example of a method for manufacturing a solution discharge unit shown in FIG. 2.

FIG. 5, for example, provides an exemplary method for manufacturing the above-configured solution discharge unit 120. For example, plate-shaped members may be formed to include the injection hole 122 (refer to FIG. 4), the discharge hole 123, and the divergence hole 124, and then the plate shaped members may be combined with each other. However, the exemplary method for manufacturing the solution discharge unit 120 is not limited to the above-noted method.

Figure 6:
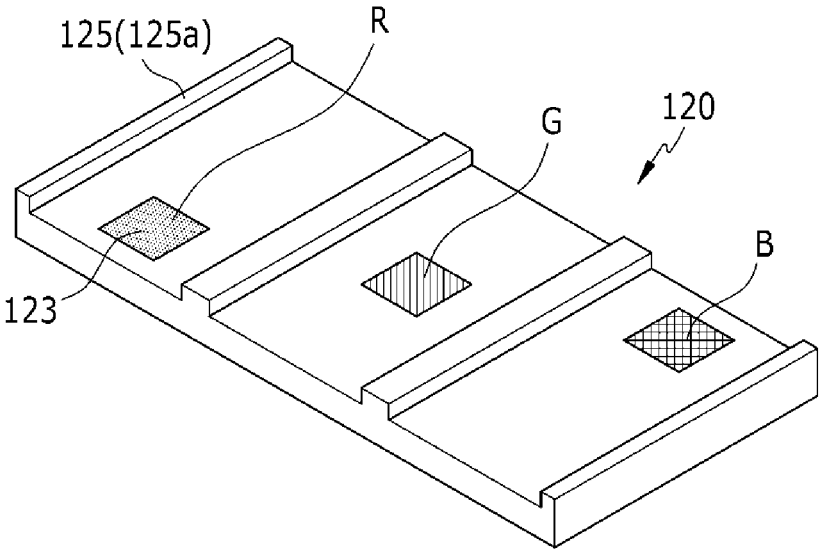
FIG. 6 and FIG. 7 show various shapes of a guide plate formed in a solution discharge unit.
Figure 7:
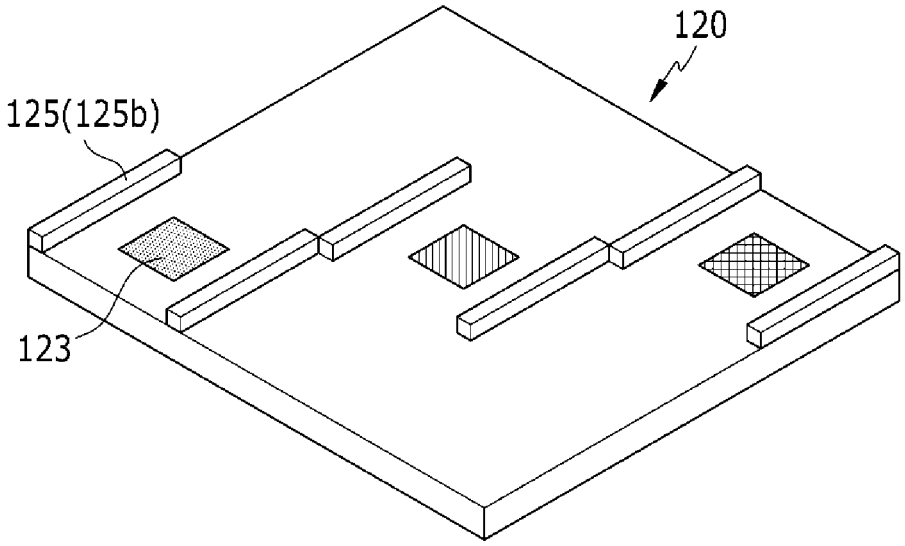

FIG. 6 and FIG. 7 show various shapes of a guide plate formed in a solution discharge unit.

Referring to FIG. 6 and FIG. 7, the solution discharge unit 120 may further include a guide plate 125.

For example, the guide plate 125 may be formed to be protruded upward from left and right areas of a plurality of discharge holes 123. The guide plate 125 may be linear to cross the top surface of the body member 121 and may be formed on the left and right sides of one of the discharge holes 123.

According to another exemplary embodiment, as shown in FIG. 7, the guide plate 125 may be formed near the discharge hole 123, and it may not be formed at a part in which the discharge hole 123 is not formed. In this case, it is possible for two guide plates 125 to be formed at an area that is near both sides of one of the discharge holes 123.

Figure 8:
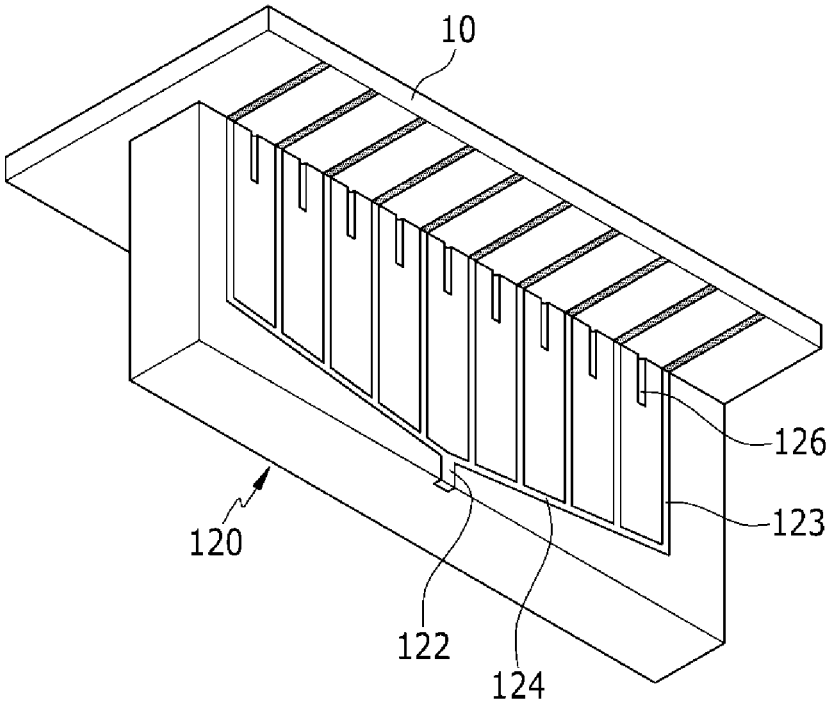
FIG. 8 shows a partial cross-sectional view for showing a state in which an air ejection hole is formed in a solution discharge unit.
Figure 9:
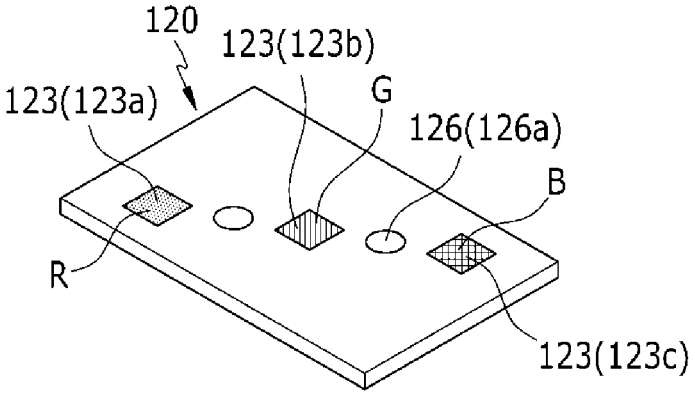
FIG. 9 and FIG. 10 show various shapes of an air ejection hole shown in FIG. 8.
Figure 10:
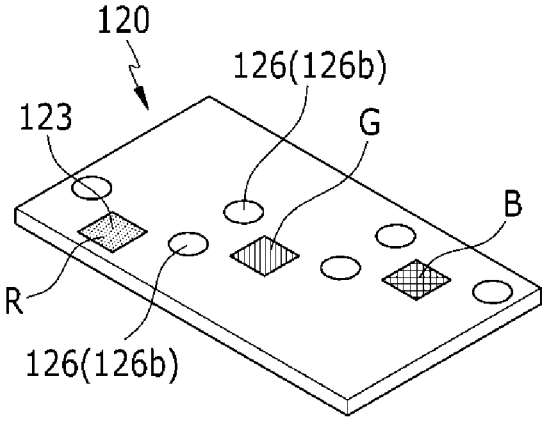

FIG. 8 is a partial cross-sectional view for showing a state in which an air ejection hole is formed in a solution discharge unit, and FIG. 9 and FIG. 10 show various shapes of an air ejection hole shown in FIG. 8.

Referring to FIG. 8 to FIG. 10, the solution discharge unit 120 included in the printing device 100 according to the exemplary embodiments may further include one or more air ejection holes 126.

The air ejection hole 126 may be formed between a plurality of discharge holes 123 and ejects gas to the substrate 10.

For example, when a discharge hole 123*a* (hereinafter referred to as a red discharge hole) for discharging a red printing solution, a discharge hole 123*b* (hereinafter referred to as a green discharge hole) for discharging a green printing solution, and a discharge hole 123*c* (hereinafter referred to as a blue discharge hole) for discharging a blue printing solution are formed in parallel at regular intervals, an air ejection hole 126*a* can be provided between the red discharge hole 123*a* and the green discharge hole 123*b* and between the green discharge hole 123*b* and the blue discharge hole 123*c*.

According to another exemplary embodiment, as shown in FIG. 10, an air ejection hole 126*b* can be formed near a plurality of respective discharge holes 123. The air ejection hole 126 ejects air when the printing solution is discharged through the discharge hole 123. Accordingly, it is controlled that the printing solution is spread to the right and the left by a pressure of the gas ejected by the air ejection hole 126. Since it is controllable that the printing solution to be spread to the right and the left, this example provides advantages to form a fine pattern on the substrate 10.

The solution discharge unit 120 included in the printing device 100 may further include one or more air inlets (not shown).

The air inlet may be formed near a plurality of respective discharge holes 123 and receives air. A vacuum pump (not shown) can be connected to the air inlet. The air inlet prevents excessive air flow near the discharge hole 123. Hence, the printing solution discharged by the discharge hole 123 can be stably printed to the substrate 10.

Figure 11:
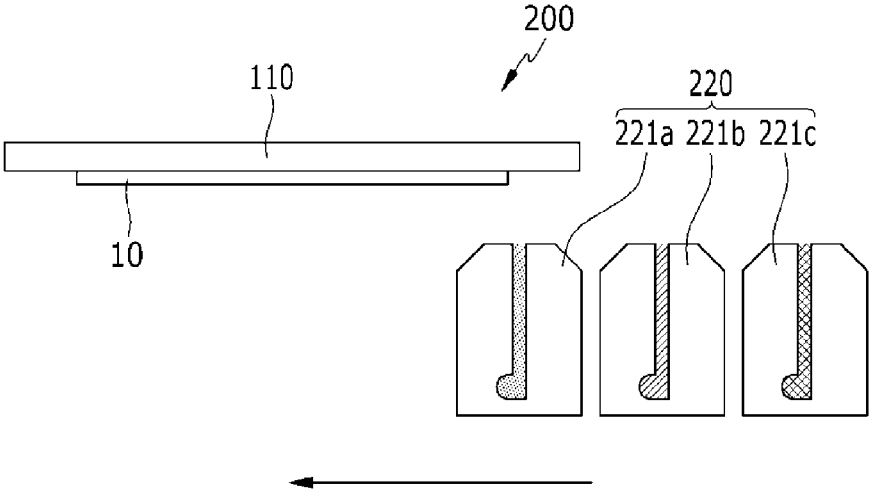
FIG. 11 shows a printing device according to exemplary embodiments of the present invention.

FIG. 11 shows a printing device according to the exemplary embodiments of the present invention.

Referring to FIG. 11, in the printing device 200, the body member 121 of a solution discharge unit 220 can be configured with a plurality of unit bodies 221*a*, 221*b*, and 221*c*.

Differing from the printing device 100 (refer to FIG. 1), according to the exemplary embodiments, one injection hole 122 can be formed in the unit bodies 221*a*, 221*b*, and 221*c*. For example, the printing solution of one color can be discharged from one of the unit bodies 221*a*, 221*b*, and 221*c*. The unit bodies 221*a*, 221*b*, and 221*c* can be disposed in parallel. As an example, the unit bodies 221*a*, 221*b*, and 221*c* can be disposed in parallel in a relative moving direction of the substrate fixing unit 110 and the solution discharge unit 220. Accordingly, the printing solution is sequentially discharged to the substrate 10 from the unit bodies 221*a*, 221*b*, and 221*c*.

The color of the printing solution injected to one injection hole 122 of one of the unit bodies 221*a*, 221*b*, and 221*c* can be selected from among red, green, and blue. For example, the printing solution of one color can be discharged from one of the unit bodies 221*a*, 221*b*, and 221*c*.

According to the exemplary embodiments, there may be three unit bodies 221*a*, 221*b*, and 221*c* which are disposed in parallel. Further, the red discharge hole 123*a*, the green discharge hole 123*b*, and the blue discharge hole 123*c* may be sequentially disposed, and the red, green, and blue printing solutions can be sequentially discharged to the substrate 10.

Figure 12:
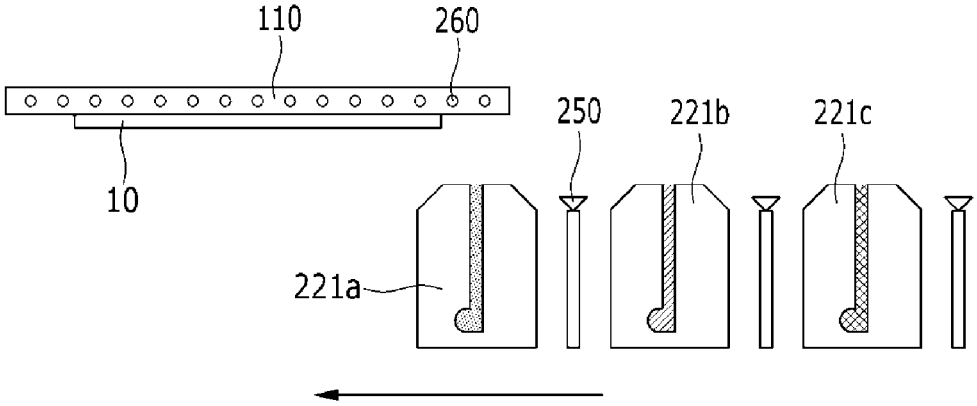
FIG. 12 shows a first drier in a printing device according to exemplary embodiments of the present invention.

FIG. 12 shows a first drier in a printing device according to the exemplary embodiments of the present invention.

Referring to FIG. 12, the above-described printing device 200 may further include the first drier 250.

The first drier 250 may be disposed between two adjacent unit bodies 221*a*, 221*b*, and 221*c* from among a plurality of unit bodies 221*a*, 221*b*, and 221*c*. The first drier 250 dries the substrate 10. A configuration of the first drier 250 is contemplated for ejecting dry air. Alternatively, for example, the first drier 250 can be an Infrared (IR) lamp.

The substrate fixing unit 110 may further include a second drier 260.

The second drier 260 may be provided near the substrate 10 and generates heat. The second drier 260 may be formed inside a part to which the substrate 10 is attached in the substrate fixing unit 110. For example, the second drier 260 can be a heating coil. The heating coil can receive power from a non-illustrated power source included in the printing device 100, or an additional power source.

When the substrate 10 is attached to the substrate fixing unit 110 and the printing solution is printed at the bottom of the substrate 10, the heating coil generates heat to quickly dry the printing pattern printed to the substrate 10.

Figure 13:
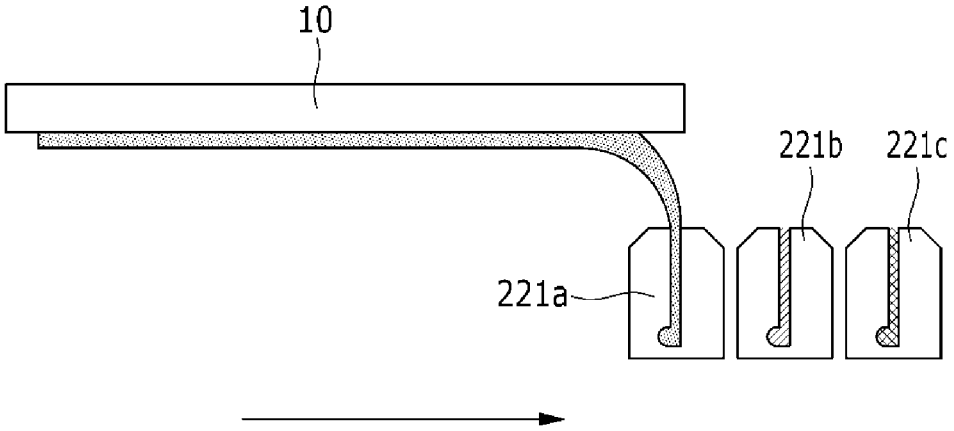
FIG. 13 shows a state in which a printing solution is discharged from a solution discharge unit in a printing device according to exemplary embodiments of the present invention.

FIG. 13 shows a state in which a printing solution is discharged from a solution discharge unit in a printing device according to the exemplary embodiments of the present invention.

As shown in FIG. 13, when a plurality of unit bodies 221*a*, 221*b*, and 221*c* move to the right in the drawing, the printing solution is discharged to the substrate starting from the unit body 221*c* that is provided to the rightmost from among the plurality of unit bodies 221*a*, 221*b*, and 221*c*, and the printing solution is finally discharged to the substrate from the unit body 221*a* that is provided to the leftmost. For example, the printing solution discharged through one unit body 221*a* is continuously discharged to the substrate because of viscosity.

Referring to FIG. 1, a process for forming a pattern of an organic light emitting diode (OLED) display by using a printing device 100 is described.

The substrate 10 on which a pattern will be formed is fixed to the substrate fixing unit 110. The fixed substrate 10 is arranged to a desired position. The solution discharge unit 120 is provided to a print start position, that is, an end of the substrate, and the storage tank 131 is finely lifted up by a lifter (not shown). The printing solution is supplied to the solution discharge unit 120 to form a meniscus at an end of the discharge hole 123 of the solution discharge unit 120. After a formation of the meniscus, the substrate 10 is finely lowered so that the substrate 10 may contact the meniscus, thereby forming a bead.

Until a coating gap of the printing solution is formed with a predetermined thickness, a gap between the substrate 10 and the solution discharge unit 120 is maintained and the solution discharge unit 120 is controlled to move at a predetermined speed thereby a pattern is formed on the substrate 10. During the solution discharge unit 120 moves, the liquid level of the printing solution is lifted according to a decrement of the solution in the storage tank 131 by using a liquid level measuring sensor.

The solution discharge unit 120 moves until the pattern is formed on the substrate 10, and the solution discharge unit 120 is then controlled to be lowered thereby incising the bead connected between the substrate 10 and the solution discharge unit 120.

In exemplary embodiments, the substrate 10 may be described to be lowered so as to form the bead, and it is not limited to this. In some examples, the solution discharge unit 120 can be lifted depending on the design.

According to the exemplary embodiments, an approach has been provided for lifting or lowering the storage tank 131 has been applied so as to form the meniscus. However it is not limited to this. In some examples, it is possible to form the meniscus through pressurization using a pump included in the solution supply unit 130.

The printing device 100 according to the exemplary embodiments continuously discharges the printing solution by using viscosity while the bead is formed that allows real-time drying. While the conventional printing device, the printing solution is discharged as droplets and the time for smoothing the film is additionally needed, in the printing device 100 according to the exemplary embodiments, the printing solution is dried in real-time so the time for forming a pattern on the substrate can be reduced.

Further, since the printing solution is continuously discharged by using the viscosity of the printing solution, differing from the conventional printing device 100 for discharging the printing solution as droplets, the printing solution becomes relatively heavier and is rarely influenced by surrounding air flows. Accordingly, reliable pattern quality can be achieved.

For example, the solution discharge unit 120 of the printing device 100 discharges the printing solutions with three colors. Therefore, various colors of patterns can be formed on the substrate 10 without providing three devices. Hence, an investment cost for providing the device for forming a pattern on the substrate 10 is reduced and the space occupied by the device is reduced, thereby increasing space usability.

Also, in the conventional printing device, the pattern may be erroneously formed by an erroneous operation of a piezo element, and in the printing device 100 according to the exemplary embodiments, the printing solution is continuously discharged by the solution discharge unit 120 without including the piezo element. As such, it is relatively advantageous in controlling the discharged amount, and a risk caused by an erroneous operation of the piezo element is reduced.

The solution discharge unit may include a body member. The unit may include one or more injection holes formed at a bottom or a lateral side of the body member. The unit may include a plurality of discharge holes passing through a top side of the body member to reach a part that is near a bottom of the body member. One or more divergence holes diverged from one of the injection holes and connected to the discharge holes.

For example, three the injection holes may be formed in the body member.

Colors of the printing solutions supplied to the three injection holes can be red, green, and blue.

The body member of the solution discharge unit is configured with a plurality of unit bodies.

The color of the injected into the injection hole of one of the unit bodies can be one of red, green, and blue.

As an example, the printing device may further include a plurality of first driers disposed between two adjacent unit bodies from among the unit bodies and drying the substrate.

The substrate fixing unit may further include a second drier provided near the substrate and generating heat.

The solution discharge unit may further include a guide plate protruded upward from a left area and a right area of the respective discharge holes.

The solution discharge unit may further include one or more air ejection holes formed between the discharge holes or near the respective discharge holes and ejecting gas to the substrate.

The solution discharge unit may further include one or more air inlets formed near the discharge holes and receiving air.

The solution discharge unit may be extended in a direction that crosses a relative moving direction with respect to the substrate fixing unit.

The discharge hole may be formed to have one of quadrangular, circular, and oval shapes as an example.

The divergence hole may be formed to have a semi-cylindrical shape.

The divergence hole may be formed to be inclined upward as it becomes distant from the injection hole.

The printing device may include a distance measurer disposed near an edge of the solution discharge unit and measuring a distance between the substrate and the solution discharge unit.

According to exemplary embodiments, the printing device is capable of real-time drying since the printing solution is continuously discharged by using viscosity while a bead is formed. Typically, the conventional printing device requires additional time for the printing solution to be discharged as droplets and smoothing the film. However, the printing device according to the exemplary embodiments is capable of reducing the printing time since the printing solution is dried in real-time.

Also, since the printing device according to the exemplary embodiments continuously discharges the printing solution by using viscosity of the printing solution, a weight of the printing solution becomes relatively heavy and the printing device is rarely influenced by a standby state, which is differing from the conventional printing device which discharges the printing solution as droplets. Therefore, reliability of pattern quality can be improved.

The printing device according to the exemplary embodiments allows the solution discharge unit to discharge the printing solution with three colors. Hence, the pattern can be formed on the substrate by using a single device without using three devices which typically to be required in prior art. Accordingly, a cost for installing the device for forming the pattern on the substrate is reduced while a space occupied by the device is reduced thereby increasing usage of the space.

In addition, while the conventional printing device may generate a bad pattern because of an erroneous operation of a piezo element, the printing device according to the exemplary embodiments does not include the piezo element and allows the printing solution to be continuously discharged by the solution discharge unit. That is, the printing device according to the exemplary embodiments is relatively advantageous in controlling a discharge amount and can reduce a risk caused by erroneous operation of the piezo element.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A printing device comprising:

a substrate fixing unit configured to have a substrate fixed thereto;

a solution discharge unit spaced apart from, and disposed below, the substrate fixing unit and configured to deliver a printing solution to the substrate by discharging printing solutions with various colors;

a solution supply unit configured to supply the printing solution to the solution discharge unit; and a drive unit configured to control the solution discharge unit to move with respect to the substrate fixing unit, wherein the substrate fixing unit is configured to be stationary during delivery of the printing solution from the solution discharge unit.

2. The printing device of claim 1, wherein the solution discharge unit comprises:

a body member;

one or more injection holes formed at a bottom or a lateral side of the body member;

a plurality of discharge holes passing through a top side of the body member to reach a part that is near a bottom of the body member; and one or more divergence holes diverged from one of the injection holes and connected to the discharge holes.

3. The printing device of claim 2, wherein three injection holes are formed in the body member.

4. The printing device of claim 2, wherein colors of the printing solutions supplied to the three injection holes are red, green, and blue.

5. The printing device of claim 2, wherein
the body member of the solution discharge unit comprises a plurality of unit bodies.

6. The printing device of claim 5, wherein
the color injected into the injection hole of one of the unit bodies is one of red, green, or blue.

7. The printing device of claim 5, further comprising
a plurality of first driers disposed between two adjacent unit bodies from among the unit bodies and configured to dry the substrate.

8. The printing device of claim 5, wherein
the substrate fixing unit further comprises
a second drier provided near the substrate and configured to generate heat.

9. The printing device of claim 2, wherein
the solution discharge unit further comprises
a guide plate protruded upward from a left area and a right area of the respective discharge holes.

10. The printing device of claim 2, wherein
the solution discharge unit further comprises
one or more air ejection holes formed between the discharge holes or near the respective discharge holes and configured to eject gas to the substrate.

11. The printing device of claim 2, wherein
the solution discharge unit further comprises
one or more air inlets formed near the discharge holes and configured to receive air.

12. The printing device of claim 2, wherein
the solution discharge unit is extended in a direction that crosses a relative moving direction with respect to the substrate fixing unit.

13. The printing device of claim 2, wherein
the discharge hole is formed to have one of a quadrangular, a circular, or an oval shape.

14. The printing device of claim 2, wherein
the divergence hole is formed to have a semi-cylindrical shape.

15. The printing device of claim 2, wherein
the divergence hole is formed to be inclined upward as it becomes distant from the injection hole.

16. The printing device of claim 2, wherein
the printing device comprises a distance measurer disposed near an edge of the solution discharge unit and configured to measure a distance between the substrate and the solution discharge unit.

17. A method comprising:
fixing a substrate to a bottom surface of a substrate fixing unit;
disposing a solution discharge unit in a bottom direction and spaced apart from the substrate fixing unit to deliver a printing solution to the substrate by discharging printing solutions with various colors;
disposing a solution supply unit to supply the printing solution to the solution discharge unit;
disposing a drive unit to control the solution discharge unit to move with respect to the substrate fixing unit,
wherein the substrate fixing unit is configured to be stationary during delivery of the printing solution from the solution discharge unit.

* * * * *